US005727258A

United States Patent [19]

Derouin

[11] Patent Number: 5,727,258

[45] Date of Patent: Mar. 17, 1998

[54] TOILET SEAT LIFTING HANDLE HAVING SCENTED ELEMENTS

[76] Inventor: Paul K. Derouin, 7862 Second St., #8, Stanton, Calif. 90680

[21] Appl. No.: 595,030

[22] Filed: Jan. 31, 1996

[51] Int. Cl.[6] ..... A47K 13/10

[52] U.S. Cl. ..... 4/246.1

[58] Field of Search ..... 4/246.1; 16/112, 16/123

[56] References Cited

U.S. PATENT DOCUMENTS 5,086,523 2/1992 De Mott et al. ..... 4/246.1
5,375,267 12/1994 Davis ..... 4/246.1

*Primary Examiner*—Charles E. Phillips
*Attorney, Agent, or Firm*—Roy A. Ekstrand

[57] ABSTRACT

A toilet seat lifting handle includes a support bracket coupled to the underside of a conventional toilet seat by an adhesive material. The bracket further supports a pivotally attached socket which in turn receives a frustro-conical handle in a removable attachment. The interior of the frustro-conical handle or grip receives a quantity of scented material which permeates outwardly through a plurality of apertures defined in the grip portion of the handle. In an alternate embodiment, an electric light is provided within the grip portion of the handle to provide illumination in low light or darkened areas and to render the handle grip easier to see. The handle grip is pivotally attached to the support bracket to facilitate pivoting the handle grip to a close alignment with the toilet seat edge avoiding undue intrusion into the remainder of the toilet facility area.

10 Claims, 3 Drawing Sheets

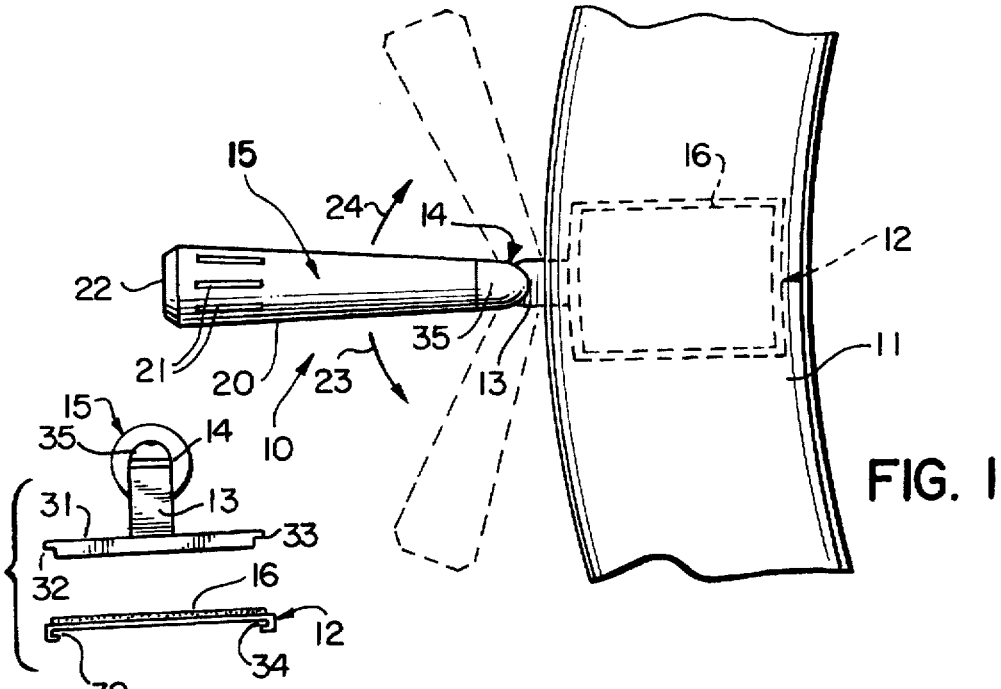
FIG. 1
FIG. 3
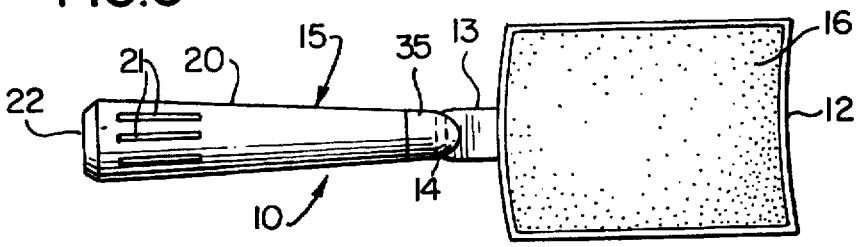
FIG. 2
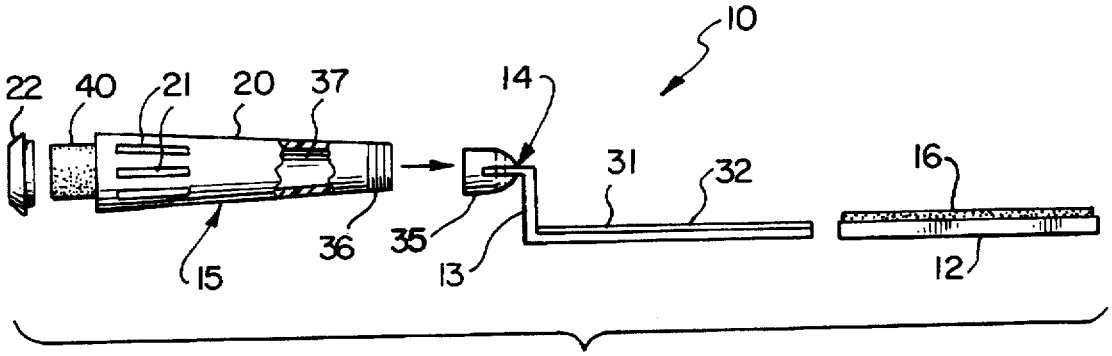
FIG. 4

TOILET SEAT LIFTING HANDLE HAVING SCENTED ELEMENTS

FIELD OF THE INVENTION

This invention relates generally to toilet seat lifting devices and particularly to those secured to the toilet seat undersurface and extending outwardly therefrom.

BACKGROUND OF THE INVENTION

In a typical toilet seat, particularly in the United States and elsewhere in North America, toilet facilities center about a toilet apparatus having a large upwardly open toilet bowl supporting a tank having a water reservoir therein and flushing apparatus all coupled to a sanitary drain. In addition, an annular or elliptical toilet seat generally having a large center hole and a convexly curved seating surface encircling it is pivotally secured to the combination of toilet bowl and tank. Generally, the toilet seat is approximately centered above the toilet bowl and rests upon its upper rim in one fashion or another.

Often, users of such toilet facilities have a need to lift or pivot the toilet seat upwardly from its lowered position or to lower it from a raised position in order to use the facility for the particular sanitary purpose they seek. However, concerns of health and sanitation on part of such users often render touching such toilet seats directly undesirable and unwholesome. This problem is particularly prevalent in connection with toilet facilities which are public or semipublic such as those found in restaurants, hotels, office buildings and so on. In such facilities, while the facility is temporarily private during use, it is all too apparent to the user that previous individuals possibly having questionable health habits and sanitary habits have utilized the toilet seat they are about to touch. Faced with the reluctance and concerns of users of such toilet facilities in connection with being forced to handle or touch such toilet seats, practitioners in the art have provided a wide variety of different toilet seat handles and lifting devices. While the shape and character of such handles is virtually endless, all generally share the common operational element of providing an extending member usually secured to the toilet seat undersurface in some fashion. The object of such extending members is to provide a convenient and more palatable point at which to engage or grasp the toilet seat and lift it. For example, U.S. Pat. Des. No. 314,322 issued to Burghoff sets forth a TOILET SEAT LIFTING HANDLE having a rectangular attachment pad supporting an outwardly extending curved handle portion. Similarly, U.S. Pat. Des. No. 325,510 issued to Slye sets forth a TOILET SEAT LIFT HANDLE having a rectangular attachment pad supporting an outwardly extending rod which terminates in a spherical ball handle.

U.S. Pat. Des. No. 341,071 issued to Prusak sets forth a TOILET SEAT HANDLE having an elongated multiply curved cylindrical rod defining an outwardly extending handle and a lower hook for grasping the underside of a toilet seat.

U.S. Pat. Des. No. 340,635 issued to Paglia sets forth a TOILET SEAT POSITIONING HANDLE having an arcuate handle supported on each end by an attachment pad.

U.S. Pat. Des. No. 309,091 issued to Shepard sets forth a TOILET SEAT HANDLE having a hand-shaped handle pivotally secured to an attachment plate.

U.S. Pat. Des. No. 273,128 issued to Roddick; U.S. Pat. Des. No. 329,186 issued to Sorensen; U.S. Pat. Des. No. 326,599 issued to Kallahan; and U.S. Pat. Des. No. 288,471 issued to Gladston all set forth various handle shapes attached to toilet seat handles by an integral attachment pad.

U.S. Pat. Des. No. 340,399 issued to Paglia sets forth a TOILET SEAT POSITIONING HANDLE having an elongated attachment member supporting an arcuate handle.

U.S. Pat. Des. No. 341,765 sets forth an ELONGATED LIFTING ROD having a cylindrical handle at its upper end coupled to a pivotal attachment to a toilet seat handle near its supporting hinge.

U.S. Pat. Des. No. 324,161 issued to MacRitchie sets forth a TOILET SEAT LIFT HANDLE having a generally L-shaped body supporting a handle on one leg of the L-shape and an attachment pad on the other end.

U.S. Pat. No. 4,129,907 issued to Vaughan, et al. sets forth a TOILET SEAT HANDLE adapted to be attached to a toilet seat and having a spherical hand engaging portion which may be readily removed for cleaning and sanitizing.

U.S. Pat. No. 4,805,246 issued to DeVargas, et al. sets forth a TOILET SEAT HANDLE attachable to the underside of a toilet for manually lifting or lowering the seat in a sanitary manner. The handle includes a deodorant cake support extending inwardly from the attachment portion of the toilet seat handle.

U.S. Pat. No. 4,358,860 issued to Church sets forth an AUTOMATIC ACTUATOR FOR AIR FRESHENER DISPENSER OR THE LIKE FOR TOILETS supported within the interior of a toilet tank. An actuator arm within the toilet tank is used to operate the valve of an air freshener device each time the toilet is flushed.

While the foregoing described prior art devices have improved the art and, in some instances enjoyed commercial success, there remains nonetheless a continuing need in the art for evermore improved toilet seat handles and lifting devices.

SUMMARY OF THE INVENTION

Accordingly, it is a general object of the present invention to provide an improved toilet seat lifting handle. It is a more particular object of the present invention to provide an improved toilet seat lifting handle having integral scenting elements.

In accordance with the present invention, there is provided for use in combination with a toilet seat pivotable between generally horizontal and vertical positions, a toilet seat lifting handle comprising: a bracket having means for attachment to the toilet seat; a socket coupled to the bracket; a handle grip defining an interior cavity, a plurality of vent apertures, a first end removably attachable to the socket, and a second end; and a quantity of scented material supported within the interior cavity of the handle grip for slowly traveling from the interior cavity through the vent apertures.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 sets forth a top view of a toilet seat lifting handle constructed in accordance with the present invention secured to a typical toilet seat;

FIG. 2 sets forth a top view of the present invention toilet seat lifting handle;

FIG. 3 sets forth an end view of the present invention toilet seat lifting handle and an attachment bracket used therewith;

FIG. 4 sets forth a side assembly view of the present invention toilet seat lifting handle;

DESCRIPTION OF THE PREFERRED EMBODIMENTS

Figure 5:
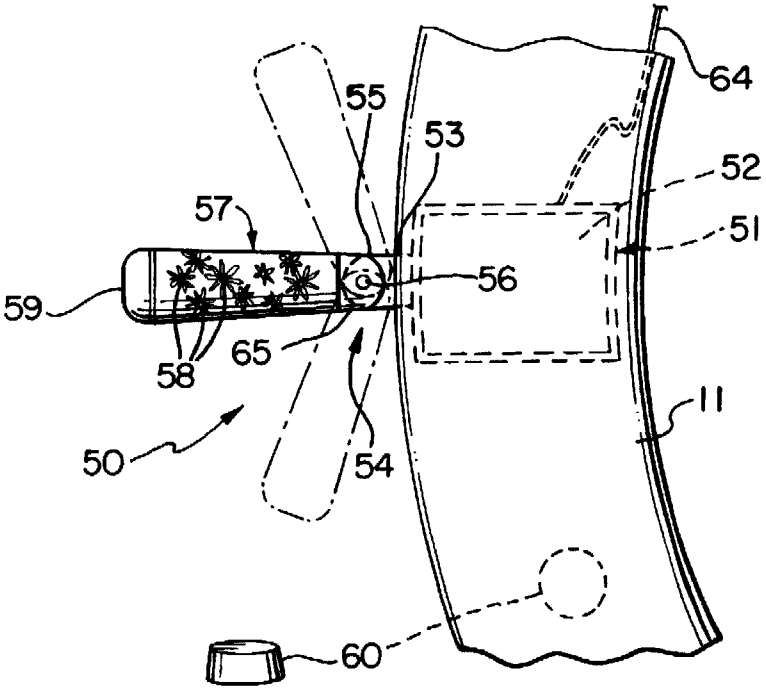
FIG. 5 sets forth a top view of an alternate embodiment of the present invention toilet seat lifting handle secured to a typical toilet seat.

FIG. 1 sets forth a top view of a toilet seat lifting handle constructed in accordance with the present invention and generally referenced by numeral 10. Lifting handle 10 is shown secured to the undersurface of a typical toilet seat 11. Handle 10 includes an attachment bracket 12 having an adhesive element 16 secured to the undersurface of toilet seat 11. Handle 10 further includes a bracket 13 which as is better seen in FIGS. 3 and 4 is coupled to a flange 31 received within attachment bracket 12. Bracket 13 further supports a pivotal attachment 14 which is secured to a socket 35 in a pivotal attachment facilitating motion of socket 35 in the directions indicated by arrows 23 and 24. Pivot 14 may comprise any one of a number of conventional pivotal attachments and may be constructed entirely in accordance with conventional fabrication techniques. Handle 10 further includes a frustro-conical grip 15 secured to socket 35 in a threaded attachment better seen in FIG. 4. Grip 15 defines an outer surface 20 having a plurality of scent apertures 21 formed therein. As is also better seen in FIG. 4, grip 15 is hollow having an interior cavity 37 formed therein. An end cap 22 is removably secured to the outer end of grip 15 and facilitates the insertion and removal of a scented cartridge to and from interior cavity 37 such as scented cartridge 40 shown in FIG. 4.

In operation, adhesive element 16 secures attachment bracket 12 to the undersurface of toilet seat 11 at a convenient spot. Normally, it is anticipated that bracket 12 is positioned near the outer edge of toilet seat 11 at a convenient place for the gripping of grip 15. Once attachment bracket 12 is secured, the remainder of handle 10 is secured to toilet seat 11 by sliding flange 31 (seen in FIG. 4) into attachment bracket 12 such that bracket 13 extends beyond the outer edge of toilet seat 11. In its anticipated use and in accordance with the present invention, a scented cartridge (seen in FIG. 4) is secured within grip 15 and slowly diffuses a stream of scented material outwardly through vent apertures 21. Grip 15 is pivotable about pivot 14 in the directions indicated by arrows 23 and 24 to the dashed line positions shown in FIG. 1. Thus, grip 15 may be positioned in accordance with the user's preference and may alternatively be pivoted to a less extending and less obtrusive position against toilet seat 11 to avoid undue restriction of movement by users near toilet seat 11. In the preferred form of the present invention, end cap 22 is preferably formed of a photoluminescent or glow in the dark material or is appropriately coated with a pigment of such material to provide easy location of grip 15 in subdued or darkened toilet facilities.

FIG. 2 sets forth an unobstructed top view of toilet seat lifting handle 10. In the drawing of FIG. 2, bracket 12 having adhesive element 16 formed on the upper surface thereof is received upon flange 31 of handle 10 (seen in FIG. 4). Thus, bracket 13 supporting pivotal attachment 14 extends outwardly from bracket 12. Grip 15 is threadably secured within socket 35 and supports end cap 22. Grip 15 further defines an outer surface 20 having a plurality of vent apertures 21 formed therein.

FIG. 3 sets forth an end view of the present invention toilet seat lifting handle having bracket 12 separated therefrom. As described above, bracket 12 includes an adhesive element 16 which in the anticipated use of the present invention is secured to the undersurface of the host toilet seat. Bracket 12 further defines inwardly extending channels 30 and 34. Correspondingly, toilet seat lifting handle 10 includes a flange 31 having a generally planar structure and defining outwardly extending lips 32 and 33. As will be apparent, flange 31 is slidably secured within bracket 12 by positioning lips 32 and 33 in alignment with channels 30 and 34 thereof. Thereafter, flange 34 may be inserted into bracket 12 as lips 32 and 33 are slidably received and captivated within channels 30 and 34 respectively. Thus, the adhesive attachment provided by adhesive 16 which secures bracket 12 provides the attachment of flange 31 to support handle 10. Also seen in FIG. 3, flange 31 supports upwardly extending bracket 13 which in turn supports pivot 14, socket 35 and grip 15 in the manner described above. It will be apparent to those skilled in the art from examination of FIGS. 1 through 3 that the use of bracket 12 and flange 31 to support the present invention toilet seat lifting handle provides a convenient advantage for the present invention structure in that a typical facility such as a hotel or the like accustomed to dealing with a transition with temporary guests using toilet facilities may elect to secure brackets such as bracket 12 to each toilet seat and to provide guests with their own personal disposable toilet seat lifting handles which may be secured in the above-described sliding engagement. In addition, a further advantage of the present invention structure is provided in that grip 15 is removable from socket 35. In such case, the typical hotel or other similar user referred to above may alternatively install the entire structure of toilet seat lifting handle 10 with the exception of grip 15 and the scented cartridge captivated therein. The temporary user of the toilet facility then may be given a personal disposable grip such as grip 15 which the user installs within socket 35 and which is discarded once the user leaves.

FIG. 4 sets forth an assembly view of the present invention toilet seat lifting handle. As described above, a bracket 12 includes an adhesive attachment 16. Handle 10 includes a flange 31 having lip portions 32 and 33 (the latter seen in FIG. 3) which permit flange 31 to be slidably received within bracket 12. Bracket 13 extends upwardly from flange 31 and is coupled to socket 35 at a pivotal attachment 14. As mentioned above, pivot 14 may be fabricated in accordance with conventional fabrication techniques. In the particular example shown for socket 35, pivot 14 is formed by an extension of bracket 13 received within a slot formed in socket 35 and secured with a transversely extending vertical pin. It will be recognized, however, that other pivotal attachments may be utilized without departing from the spirit and scope of the present invention. While not seen in FIG. 4, it will be understood that socket 35 preferably defines a plurality of interior threads. Correspondingly, grip 15 defines a generally frustro-conical structure having an outer surface 20 defining a plurality of vent apertures 21. The smaller end of grip 15 defines a plurality of threads 36 received within socket 35. Grip 15 further defines an interior cavity 37 communicating with vent apertures 21 which receives a scented cartridge 40. An end cap 22 provides closure of interior cavity 37 captivated scented cartridge 40. In the anticipated use of the present invention, scented cartridge 40 slowly diffuses or releases scented material from interior cavity 37 which permeates outwardly through vent apertures 21 providing a pleasing scent or deodorizing effect within the toilet facility.

FIG. 5 sets forth a top view of an alternate embodiment of the present invention toilet seat lifting handle generally referenced by numeral 50. Handle 50 includes an attachment pad 51 secured to the undersurface of a typical toilet seat 11 using an adhesive element 52. Attachment pad 51 supports an extending bracket 53 which in turn is pivotally secured to a socket 55 by a pivotal attachment 54. Pivotal attachment 54 is constructed in accordance with conventional fabrication techniques and in the example of FIG. 5 utilizes a pivot pin 56. Socket 55 further supports a conventional bulb 65 and is coupled to a frustro-conical grip 57. Grip 57 is hollow and defines an interior cavity (not shown). Grip 57 further defines a plurality of vent apertures 58 which in the example of FIG. 5 define snowflake or flower-like shapes. An end cap 59 is secured to the outer end of grip 57. The pivotal attachment of socket 55 to bracket 53 facilitates the pivotal movement of grip 57 to the dashed-line positions shown in FIG. 5 thereby providing handle 50 with the capability of pivoting grip 57 away from undue extension into the space surrounding toilet seat 11 and interference with movement of individuals near the host toilet seat. As is better seen in FIG. 6, attachment pad 51 includes a lower housing which receives a plurality of conventional batteries. To accommodate the additional thickness of attachment pad 51, it may be desirable to utilize a disk-shaped spacer 60 which may be secured to the undersurface of toilet seat 11 as shown in dashed-line representation in FIG. 5.

In operation, the battery power source (seen in FIG. 6) within attachment pad 51 provides energy for illuminating bulb 65 within socket 55. The resulting illumination is transmitted to the interior of grip 57 and is allowed to diffuse outwardly through the various apertures 58 formed in grip 57. The illumination provided by bulb 65 is particularly useful in the application of present invention toilet seat lifting handle in facilities having reduced lighting or dark light conditions. In addition, the heat provided by bulb 65 may be utilized to aid the diffusion and outward flow of the scented material within scent cartridge 66 (seen in FIG. 6). In addition, it may be desirable in some applications to form end cap 59 of a photoluminescent or glow in the dark material to further aid in observing grip 57 under low lighting conditions.

It will be apparent to those skilled in the art that the battery power source set forth below in FIG. 6 within attachment pad 51 may alternatively be replaced by a conventional alternating current power source or low voltage power source in order to avoid the undesired effect of battery recharging or replacement. In such case, a conventional bulb energizing source may be supported within attachment pad 51 and coupled to a local source of operative power using a wire connection 64. In any event, the apparatus used to energize bulb 65 whether battery powered or auxiliary powered from an external power source may be constructed entirely in accordance with conventional fabrication techniques. One alternative which may be particularly attractive is to utilize a light emitting diode in place of bulb 65 due to its lower power consumption and to support a conventional light emitting diode energizing circuit within attachment pad 51. In any event, the essential feature of the embodiment of the present invention shown in FIGS. 5 and 6 is the provision of a suitable source of light energy to aid in finding and locating grip 57 in subdued lighting conditions.

Figure 6:
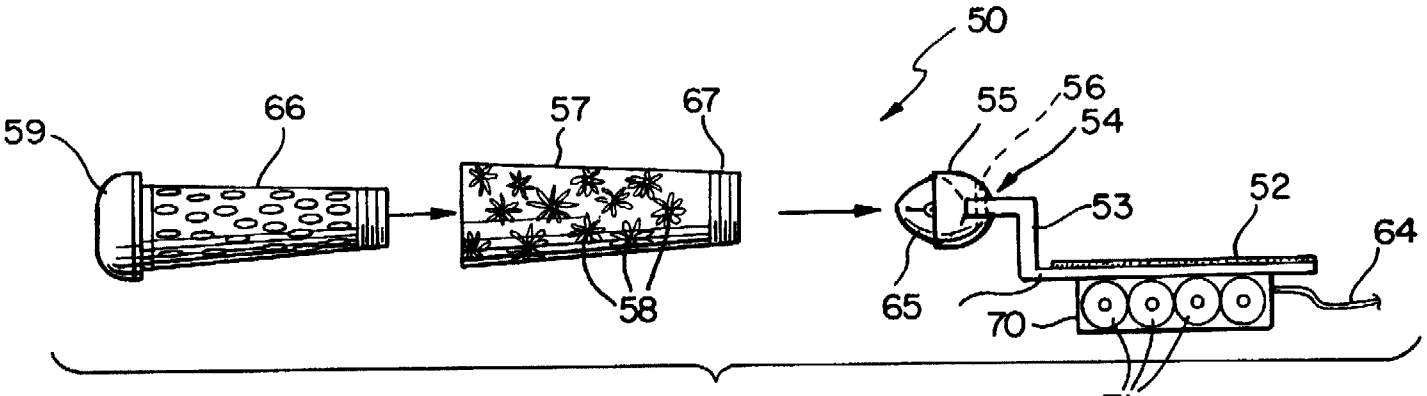
FIG. 6 sets forth a side assembly view of the alternate embodiment of FIG. 5.

FIG. 6 sets forth an assembly view of the toilet seat lifting handle embodiment of FIG. 5. As described above, handle 50 includes an attachment pad 51 supporting an upwardly extending bracket 53 and an adhesive member 52. Bracket 53 is coupled to a socket 55 by a pivotable attachment 54 which includes a pivot pin 56. A bulb 65 or other suitable lighting element is supported within socket 55. A housing 70 formed on the undersurface of attachment pad 51 supports a plurality of conventional batteries 71 and an auxiliary power connection wire set 64. While not shown in FIG. 6, it will be understood that conventional connection apparatus such as wires or printed conductive pads are coupled between the power source within housing 70 and bulb 65 to facilitate the energizing of bulb 65. Handle 50 further includes a frustro-conical grip 57 defining a plurality of apertures 58 and a threaded portion 67. Threaded portion 67 is threadably received within socket 55 in a conventional threaded attachment. A scent material cartridge 66 is received within the interior of grip 57 and secured therein by an end cap 59. Grip 57 defines an interior cavity similar to interior cavity 37 of grip 15 shown in FIG. 4. Scent cartridge 66 is removable and replaceable by removing end cap 59 from grip 57. It will be apparent to those skilled in the art that while flower-shaped or snowflake-like shaped apertures 58 are formed in grip 57 that virtually any shaped aperture or combination of shapes may be utilized to provide the transfer of illumination from bulb 65 and the permeation of scented material from scent cartridge 66. It will be equally apparent that scent cartridge 66 may utilize virtually any scented material and deodorant material as desired.

Figure 7:
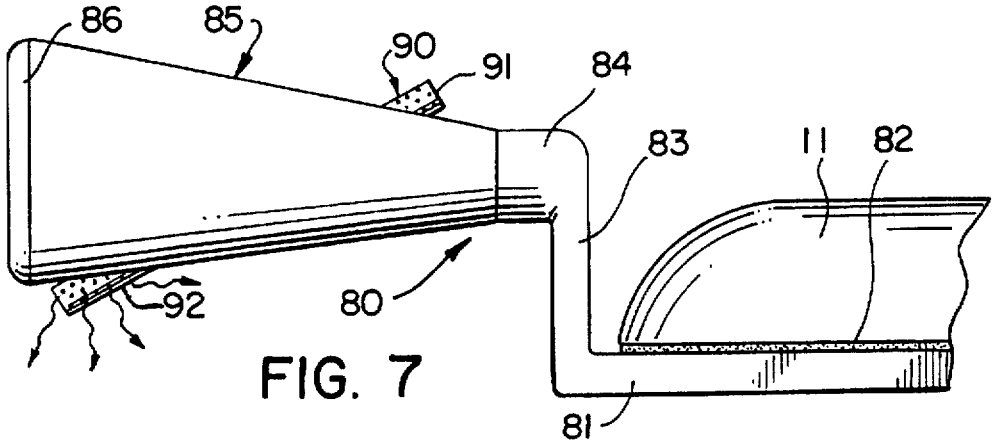
FIG. 7 sets forth a side view of a still further alternate embodiment of the present invention toilet seat lifting handle.

FIG. 7 sets forth a side view of a further embodiment of the present invention toilet seat lifting handle generally referenced by numeral 80. Toilet seat lifting handle 80 includes an attachment pad 81 secured to the undersurface of a conventional toilet seat 11 by an adhesive pad 82. A bracket 83 extends upwardly from attachment pad 81 and terminates in an outwardly facing socket 84. A frustro-conical grip 85 is secured to socket 84 and supports an end cap 86. An elongated preferably cylindrical diffusion tube 90 having a pair of opposed ends 91 and 92 is received within apertures 75 and 76 (seen in FIG. 8) formed within grip 85. While the structure of diffusion tube 90 and its attachment to grip 85 is set forth below in greater detail, suffice it to note here that diffusion tube 90 extends through grip 85 and defines a plurality of small apertures for slowing diffusing a liquid scented material or deodorant material captivated within grip 85.

In operation and by means set forth below in greater detail, a small quantity of scented liquid is transferred from the interior of grip 85 to the lower one of ends 91 and 92 of diffusion tube 90 each time toilet seat 11 is pivoted between the lowered or horizontal position and the raised or vertical position. As is also described below in greater detail particularly FIGS. 9 and 10, the pivoting motion of toilet seat 11 as toilet seat 11 is raised or lowered produces a ninety degree rotation of grip 85 causing ends 91 and 92 of diffusion tube 90 to be alternately lowered and raised with respect to grip 85. Thus, in the anticipated use of the embodiments of the present invention set forth in FIGS. 7 through 10, a small quantity of scented or deodorant liquid is transferred to the lower one of end 91 and 92 of diffusion tube 90 and permeates outwardly through the plurality of small apertures formed in the diffusion tube. The gravity responsive valve mechanism shown in FIGS. 8 through 10 below provide for a transfer of the scented or deodorant liquid solely to the lower one of the two end portions of diffusion tube 90.

Figure 8:
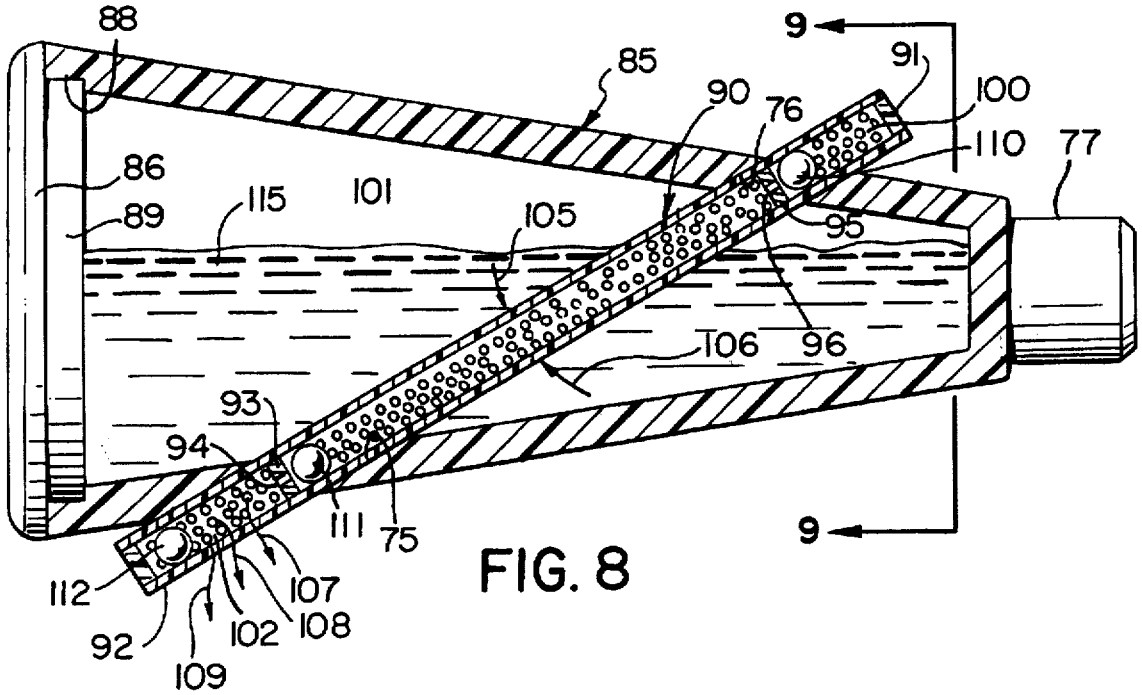
FIG. 8 sets forth a section view of the handle portion of the present invention embodiment of FIG. 7.

FIG. 8 sets forth a section view of grip 85 and diffusion tube 90. As described above, grip 85 defines a frustroconical member having an end cap 86 secured thereto. Grip 85 further includes an interior cavity 87 and an inwardly extending plug 77. The latter is received within socket 84 (seen in FIG. 7). The outer end of grip 85 preferably defines a recess 88 which receives plug 89 of end cap 86 for a secure liquid tight seal which is preferably a tight or snap-fit attachment. Alternatively, however, recess 88 and plug 89 may be threaded if desired. Grip 85 defines a pair of slanted apertures 76 and 75 which receive an elongated cylindrical diffusing tube 90. Diffusing tube 90 is substantially hollow and cylindrical defining a plurality of small apertures therein. Diffusion tube 90 further includes closed end portions 91 and 92 together with a pair of intermediate valve walls 93 and 95. Valve wall 93 is positioned proximate end 92 and defines an aperture 94 while valve wall 95 is positioned proximate end 91 and defines an aperture 96. Thus, valve walls 93 and 95 divide the interior of diffusing tube 90 into a middle chamber 101, an end chamber 100 and an end chamber 102. Diffusing tube 90 extends through apertures 75 and 76 and is positioned and supported by grip 85 such that ends 91 and 92 extend slightly beyond the outer surface of grip 85. A spherical ball formed of a heavy metal such as steel 110 is loosely received within chamber 100 while similar metal balls 111 and 112 are loosely received within middle chamber 101 and end chamber 102. Balls 110, 111 and 112 are freely movable within their respective chambers in response to gravitational forces upon them despite the presence of liquid within their respective chambers. In further accordance with the present invention, a quantity of scented or deodorant liquid is captivated within interior cavity 87 of grip 85.

In operation, the liquid within interior cavity 87 flow into middle chamber 101 of diffusion tube 90 in the manner indicated by arrows 105 and 106 due to the plurality of small apertures in the diffusion tube wall. Wall 111 is acted upon by gravitational forces and thus rests against valve wall 93 in the position shown in FIG. 8 providing closure of aperture 94 and preventing liquid flow from middle chamber 101 to end chamber 102. Similarly, ball 110 rests against valve wall 95 and provides closure of aperture 106. Thus, in the position shown in FIG. 8 in which end 91 of tube 90 is raised and end 92 is lowered, liquid 115 fills middle chamber 101 and is precluded from moving into end chamber 102. Ball 110 closing aperture 96 prevents evaporation of liquid from middle chamber 101 outwardly through end chamber 100. Liquid having been transferred to end chamber 102 as end 92 moves previously from the higher position to the lower position shown in FIG. 8 is then allowed to evaporate outwardly through the apertures formed in end chamber 102 as shown by arrows 107 through 109. Once the quantity of liquid has evaporated, however, no further liquid material may evaporate until grip 85 undergoes the next cycle of ninety degree rotation due to the toilet seat being raised or lowered.

Figure 10:
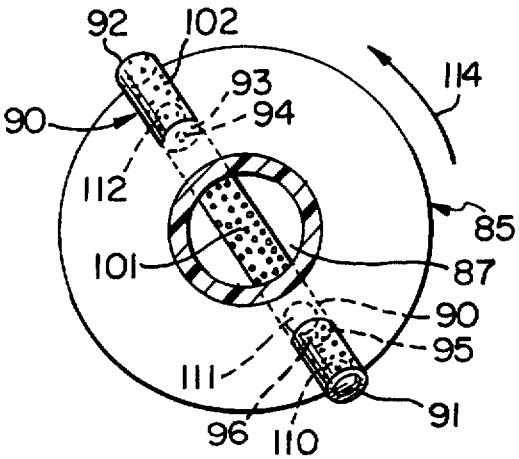
FIG. 10 sets forth a section view of the embodiment of the present invention of FIG. 8 taken along section lines 9—9 therein rotated ninety degrees.
Figure 9:
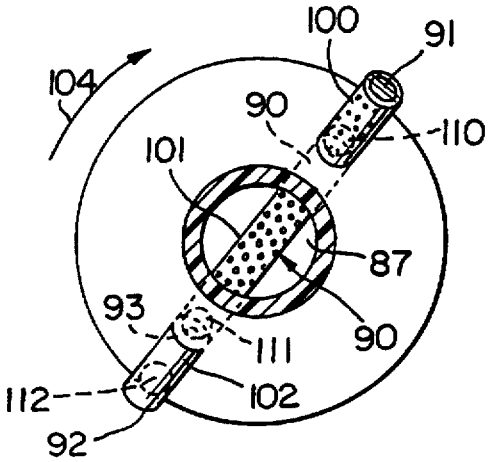
FIG. 9 sets forth a section view of the embodiment of FIG. 8 taken along section lines 9—9 therein.

The operative cycle of the present invention embodiment shown in FIGS. 7 through 10 is best understood by simultaneous reference to FIGS. 8, 9 and 10. More specifically, FIG. 9 sets forth a section view of grip 85 taken along section lines 9—9 in FIG. 8 showing end 91 in the raised position and end 92 of diffusion tube 90 in the lower position. If, for example, grip 85 is positioned in the manner shown in FIG. 9 when toilet seat 11 (seen in FIG. 7) is in the seat up or raised position, the above-described evaporation of scented liquid from end chamber 102 takes place. In the event toilet seat 11 is pivoted from the raised or seat up position to the lowered or seat down position, grip 85 undergoes a clockwise rotation in the direction indicated by arrow 104 of approximately ninety degrees and assumes the position shown in FIG. 10. Thus, FIG. 10 shows the position of grip 85 and diffusion tube 90 in the lowered or seat down position of toilet seat 11 (seen in FIG. 7). As grip 85 rotates in the direction of arrow 104 to the seat down position of FIG. 10, end 91 of diffusion tube 90 rotates downwardly while end 92 rotates upwardly. The change in position of end 91 and 92 causes ball 110 to move toward end 91 of diffusion tube 90 while ball 112 moves toward valve wall 93. Concurrently, ball 111 moves away from valve wall 93 toward valve wall 95 through the liquid filled middle chamber of chamber 101. The rate at which ball 111 moves toward valve wall 95 is determined by the viscosity of liquid 115 used in grip 85 and the size of aperture 96. During the time required for ball 111 to traverse middle chamber 101 and close aperture 96 of valve wall 95, a small amount of liquid determined by the liquid viscosity and the size of aperture 96 is transferred from middle chamber 101 to end chamber 100. Once ball 111 reaches wall 95, however, this transfer is terminated and no further liquid is transferred to end chamber 100. Correspondingly, ball 112 is moved to wall 93 closing aperture 94 and preventing evaporation of liquid from middle chamber 101 outwardly through aperture 94 and end chamber 102. Thus, once grip 85 has rotated in the clockwise direction from the position shown in FIG. 9 to that shown in FIG. 10, the relative positions of ends 91 and 92 shown in FIG. 8 will have been reversed and the positions of balls 110, 111 and 112 will be correspondingly changed. During the time toilet seat 11 is maintained in the lowered or seat down position, the quantity of liquid thus transferred to end chamber 100 slowly evaporates outwardly through the plurality of apertures formed therein. In the event toilet seat 11 is pivoted upwardly again to the raised position, grip 85 is rotated in the direction indicated by arrow 114 returning diffusion tube 90 to the position shown in FIG. 9 and transferring a quantity of liquid to end chamber 102.

Thus, each time toilet seat 11 is either raised or lowered, a small quantity of liquid is transferred to the lower one of the two end chambers of the diffusion tube for evaporation and scent or deodorant material evaporation into the surrounding area of the toilet facility. This cycle is repeated over time and the quantity of liquid within interior cavity 87 is slowly evaporated or diffused into the toilet facility atmosphere. At any given time, grip 85 may be removed from socket 84 and the quantity of liquid within interior cavity 87 may be replenished by removing end cap 86.

What has been shown is a novel approach to fabrication of a toilet seat lifting handle which provides the convenience and desirable effect of scent or deodorant material evaporation into the toilet facility. In addition, the invention provides a glow in the dark or electrically powered light accessory which renders the toilet seat handle easy to see in a low light or darkened toilet area. The invention shown readily accommodates a disposable handle grip for use in the toilet seat handle further aiding in the sanitary assurance provided to the user.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a toilet seat pivotable between generally horizontal and vertical positions, a toilet seat lifting handle comprising:

a bracket having means for attachment to said toilet seat;

a socket;

a handle grip defining an interior cavity, a plurality of vent apertures, a first end removably attachable to said socket, and a second end;

pivotal attachment means for pivotally securing said socket to said bracket such that said handle grip and said socket are pivotable in a horizontal direction when said toilet seat is in its horizontal position; and a quantity of scented material supported within said interior cavity of said handle grip for slowly traveling from said interior cavity through said vent apertures.

2. A toilet seat lifting handle as set forth in claim 1 wherein said quantity of scented material includes a scent cartridge and wherein said interior cavity is configured to receive and enclose said scent cartridge.

3. A toilet seat lifting handle as set forth in claim 2 wherein said handle grip includes a photoluminescent cap secured to said second end of said handle grip.

4. A toilet seat lifting handle as set forth in claim 1 wherein said means for attachment include:

an attachment bracket having adhesive attachment means and flange receiving means; and a flange receivable in attachment to said flange receiving means and coupled to said bracket.

5. A toilet seat lifting handle as set forth in claim 4 further including:

an electrical light producing element supported within said socket for producing illumination of said handle grip; and an electrical power source supported by said attachment bracket for energizing said electrical light-producing element.

6. A toilet seat lifting handle as set forth in claim 5 wherein said electrical light producing element includes a light bulb and wherein said electrical power source includes a plurality of batteries.

7. A toilet seat lifting handle as set forth in claim 1 wherein said quantity of scented material is a liquid and wherein said handle grip includes gravity-responsive valve means for evaporating a small quantity of said liquid in response to movement of said handle grip caused by raising or lowering said toilet seat.

8. For use in combination with a toilet seat pivotable between generally horizontal and vertical positions, a toilet seat lifting handle comprising:

a bracket having means for attachment to said toilet seat;

a socket including a pivotable coupler pivotally securing said socket to said bracket for horizontal pivotal motion of said socket when said toilet seat is in its horizontal position; and a scented handle grip detachably received in and pivotal with said socket, said grip having a photoluminescent portion.

9. A toilet seat lifting handle as set forth in claim 8 wherein said scented handle grip includes an interior reservoir for receiving a scented liquid and gravity-responsive valve means for dispersing a portion of said scented liquid into the surrounding air after said toilet seat is pivoted.

10. A toilet seat lifting handle as set forth in claim 8 wherein said means for attachment includes:

an attachment bracket defining a pair of channels;

an adhesive member for securing said attachment bracket to said toilet seat; and a flange defining a pair of lips slidably receivable within said pair of channels coupled to said bracket.

* * * * *